US010875347B2

(12) United States Patent
De Silva

(10) Patent No.: US 10,875,347 B2
(45) Date of Patent: Dec. 29, 2020

(54) DUAL PAGE BOOKMARK

(71) Applicant: Franco De Silva, San Antonio, TX (US)

(72) Inventor: Franco De Silva, San Antonio, TX (US)

( * ) Notice: Subject to any disclaimer, the term of this patent is extended or adjusted under 35 U.S.C. 154(b) by 181 days.

(21) Appl. No.: 15/212,222

(22) Filed: Jul. 16, 2016

(65) Prior Publication Data

US 2018/0015770 A1 Jan. 18, 2018

(51) Int. Cl.
*B42D 9/00* (2006.01)

(52) U.S. Cl.
CPC ..... *B42D 9/005* (2013.01)

(58) Field of Classification Search
CPC ..... B42D 9/005; B42D 9/008
See application file for complete search history.

(56) References Cited

U.S. PATENT DOCUMENTS 1,540,777 A * 6/1925 Hellerman ..... B42D 3/14 116/239
2,269,567 A * 1/1942 Weglein, Jr. ..... B42D 9/005 116/237
2,778,331 A * 1/1957 Solis Bonilla ..... B42D 9/004 116/234
3,158,131 A * 11/1964 Salayka ..... B42D 3/14 116/237
3,381,654 A * 5/1968 Hupp ..... B42D 9/005 116/237
4,487,156 A * 12/1984 Frost ..... B42D 9/008 116/234
4,732,107 A * 3/1988 Jacobsen ..... B42D 9/005 116/237
4,793,632 A * 12/1988 Hoffman, Jr. ..... B42D 3/14 116/238
4,941,684 A * 7/1990 Frank ..... B42D 3/145 116/237
5,249,546 A * 10/1993 Pennelle ..... B42D 9/005 116/234
5,992,887 A * 11/1999 Maruchi ..... B42D 9/005 24/67.9
6,015,166 A * 1/2000 May ..... B42D 9/005 281/42
7,066,494 B1 * 6/2006 Di Prinzio ..... B42D 9/005 116/234
2002/0166497 A1 * 11/2002 Rae ..... B42D 9/005 116/237

(Continued)

*Primary Examiner* — David R Dunn
*Assistant Examiner* — Christopher E Veraa
(74) *Attorney, Agent, or Firm* — Wayne J. Colton, Inc.

(57) ABSTRACT

A dual page bookmark for encouraging personal reading goals includes a planar anchor having a flap extending therefrom. The anchor has an interior edge conforming to the spline edge of a page and a top edge. The flap has an interior edge extending from a point about the midsection of the top edge of the anchor. The interior edge converges with an outer edge of the flap at an end point even with the midsection of the top edge of anchor. The outer edge is formed with a pronounced curvature, which is necessary to the automatic repositioning of the flap as one page of the book is turned to present the next page. A curved interface between the planar portion of the flap and the top edge of the anchor, which biases the planar portion of the flap in the direction of the anchor.

7 Claims, 5 Drawing Sheets

(56) References Cited

U.S. PATENT DOCUMENTS

| | | | | |
|---|---|---|---|---|
| 2006/0283371 | A1* | 12/2006 | Faskowicz | B42D 9/005 116/234 |
| 2007/0209264 | A1* | 9/2007 | Lau | B42D 5/005 40/641 |
| 2009/0101061 | A1* | 4/2009 | Almodovar | B42D 9/005 116/235 |
| 2012/0031322 | A1* | 2/2012 | Spaargaren | B42D 9/005 116/237 |

* cited by examiner

DUAL PAGE BOOKMARK

FIELD OF THE INVENTION

The present invention relates to education. More particularly, the invention relates to a dual page bookmark specially adapted to promote the setting and accomplishment of personal reading goals.

BACKGROUND OF THE INVENTION

Readers have long used all manner of techniques for keeping tracking reading progress, ranging from "dog ears" on pages to simple bookmarks. While these techniques are generally effective at maintaining one's place, none of the known prior art techniques provide any integral motivation to the learning reader. Additionally, none of the known prior art techniques provide simple and effective automatic operation, and are all therefore susceptible to inadvertent loss of the current page, which in turn actually acts to impair motivation.

With the foregoing deficiencies of the prior art clearly in mind, it is therefore an overriding object of the present invention to improve over the prior art by providing a dual page bookmark that allows a reader to simultaneously mark the current page as well as a later page that the reader has set as a goal for a reading session.

It is a further object of the present invention to provide such a dual page bookmark that is also specifically adapted to automatically keep track of the current page as the reader simply turns from one page to the next.

It is a yet further object of the present invention to provide such a dual page bookmark that does not in any way interfere with reading or otherwise viewing the current page.

It is also an object of the present invention to provide such a dual page bookmark that is capable of all of the foregoing features while also presenting additional printed matter to the reader, such as, for example, motivational and/or congratulatory statements or even advertising content.

Finally, it is an object of the present invention to provide such a dual page bookmark that is durable in use, but also economical to manufacture, thereby ensuring the widest possible availability for the benefits thereof.

SUMMARY OF THE INVENTION

In accordance with the foregoing objects, the present invention—a dual page bookmark for encouraging personal reading goals—generally comprises a planar anchor having a flap extending therefrom. The planar anchor, which is most preferably formed in a substantially rectilinear shape, comprises an interior edge adapted to lie adjacent to a substantial length of the spline edge of a page of a book; a top edge; and front and rear faces, which may be provided with printed matter such as motivational and/or congratulatory statements.

The flap generally comprises an interior edge, which extends from a point along the midsection of the top edge of the anchor, thereby ensuring that the flap does not become entangled between spline edges of adjacent pages. The interior edge of the flap converges with an outer edge of the flap at an end point generally located about even with the point along the midsection of the top edge of anchor. In a critical aspect of the present invention, this outer edge of the flap, which extends from about the distal end of the top edge of the anchor, is formed with a pronounced curvature, which is necessary to the automatic repositioning of the flap as one page of the book is turned to present the next page. Additionally, and also in support of this aspect of the present invention, the flap comprises a curved interface between a planar portion of the flap and the top edge of the anchor, and which is adapted to bias the planar portion of the flap in the direction of the anchor.

In order to prevent interference with normal reading of a page of the book, it is also considered a critical aspect of the present invention that the planar portion of the flap should be constructed of a substantially translucent material, such as, for example, plastic film. Given this requirement, Applicant has found it expedient to construct the entire bookmark from a plastic film type material. As discovered by Applicant, this also provides the additional benefit of causing the anchor to be statically held in place, thereby preventing inadvertent dislodging of the bookmark as pages of the book are turned.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 2:
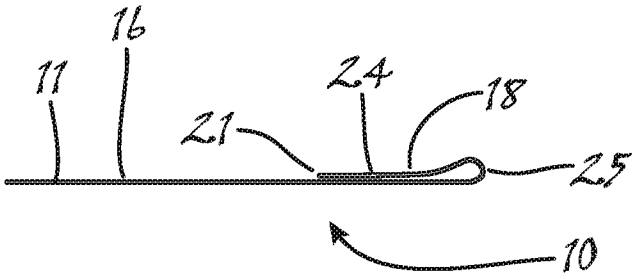
FIG. 2 shows, in a side elevational view, the dual page bookmark of FIG. 1, as resting in its operable position.
Figure 1:
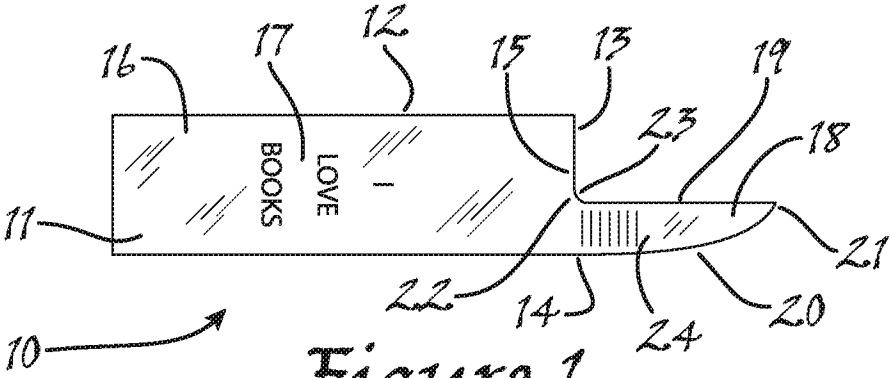
FIG. 1 shows, in a top plan view, the most preferred implementation of the dual page bookmark of the present invention, as laid flat for clarity.

Referring now to the figures, and to FIGS. 1 and 2 in particular, the most preferred implementation of the dual page bookmark 10 for encouraging personal reading goals of the present invention is shown to generally comprise a planar anchor 11 having a flap 18 formed unitary or integral therewith. As best shown in FIG. 1, the planar anchor 11, which is most preferably formed in a substantially rectilinear shape, comprises an interior edge 12 adapted to lie adjacent to a substantial length of the spline edge 29 of a goal page 30 of a book 26, as will be better understood further herein; a top edge 13; and a top face 16 and rear face. As shown in the figure, the top face 16 and/or rear face may be, and are preferably, provided with printed matter 17, such as, most preferably, motivational and/or congratulatory statements, or, alternatively, advertising or other content.

As also shown in FIGS. 1 and 2, the flap 18 generally comprises an interior edge 19, which extends from a point 15 along the midsection of the top edge 13 of the planar anchor 11, thereby ensuring that the flap 18 does not become entangled between spline edges 29 of adjacent pages of a book 26, but rather is free to move during the ordinary turning of the current page 27 to present the following page, as will be better understood further herein. Although some variation may be had, the end point 21, at the convergence of the interior edge 19 of the flap 18 with an outer edge 20 of the flap 18, is generally located about even with the point 15 along the midsection of the top edge 13 of the planar anchor 11.

In a critical aspect of the present invention, the outer edge 20 of the flap 18, which extends from about the distal end 14 of the top edge 13 of the planar anchor 11, is formed with a pronounced curvature, which, as will be better understood further herein, is necessary to the automatic repositioning of the flap 18 as the current page 27 of the book 26 is turned to present the next following page. Additionally, and also in support of this aspect of the present invention, the flap 18 comprises a curved interface 25, as best shown in FIG. 2, between a planar portion 24 of the flap 18 and the top edge 13 of the anchor 11. As will be better understood further herein, this curved interface 25 provides a critical biasing of the flap 18 in the direction of the top face 16 of the planar anchor 11.

Figure 4:
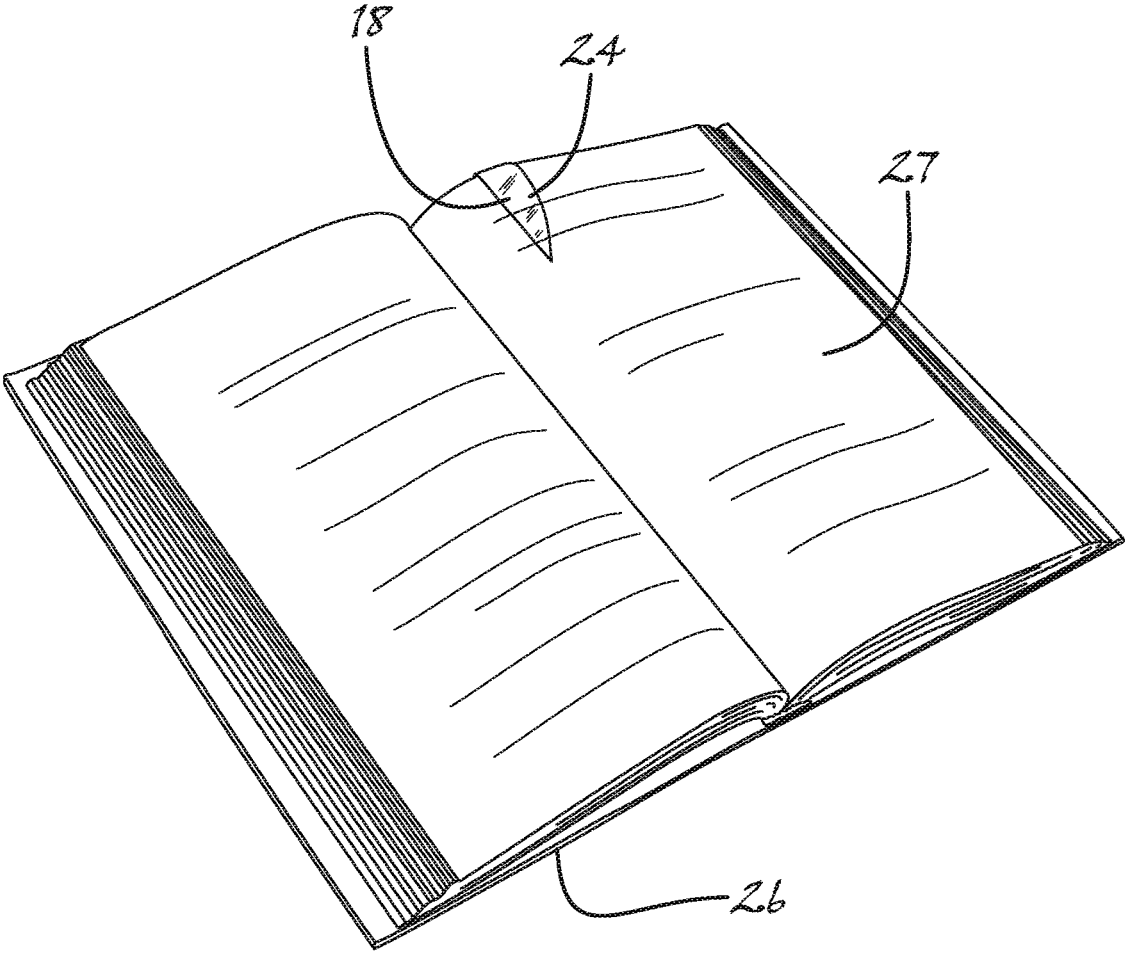
FIG. 4 shows, in a perspective view, details of the final placement for use with a book of the dual page bookmark of FIG. 1.

In order to prevent interference with normal reading of the current page 27 of the book 26, it is also considered a critical aspect of the present invention that the planar portion 24 of the flap 18, as particularly shown in FIG. 4, should be constructed of a substantially translucent material, such as, for example, plastic film. Given this requirement, Applicant has found it expedient to construct the entire bookmark 10 from a plastic film type material. As discovered by Applicant, this also provides the additional benefit of causing the anchor 11 to be statically held in place, thereby preventing inadvertent dislodging of the bookmark 10 as the current page 27 of the book 26 is turned to present the next page.

As also shown in FIG. 1, the interior corner 22 between the interior edge 19 of the flap 18 and the top edge 13 of the anchor 11 is preferably provided with a curved relief 23. This provision prevents tearing of the flap 18 from the anchor 11, thereby ensuring maximum durability of the dual page bookmark 10.

Figure 5:
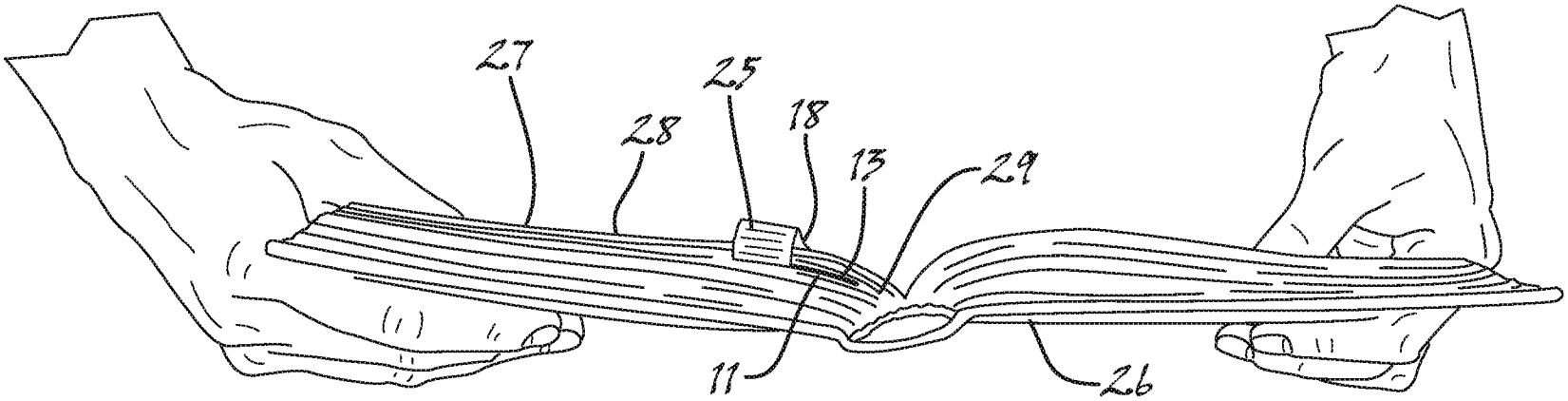
FIG. 5 shows, in a perspective view, yet further details of the initial placement for use with a book of the dual page bookmark of FIG. 1.
Figure 3:
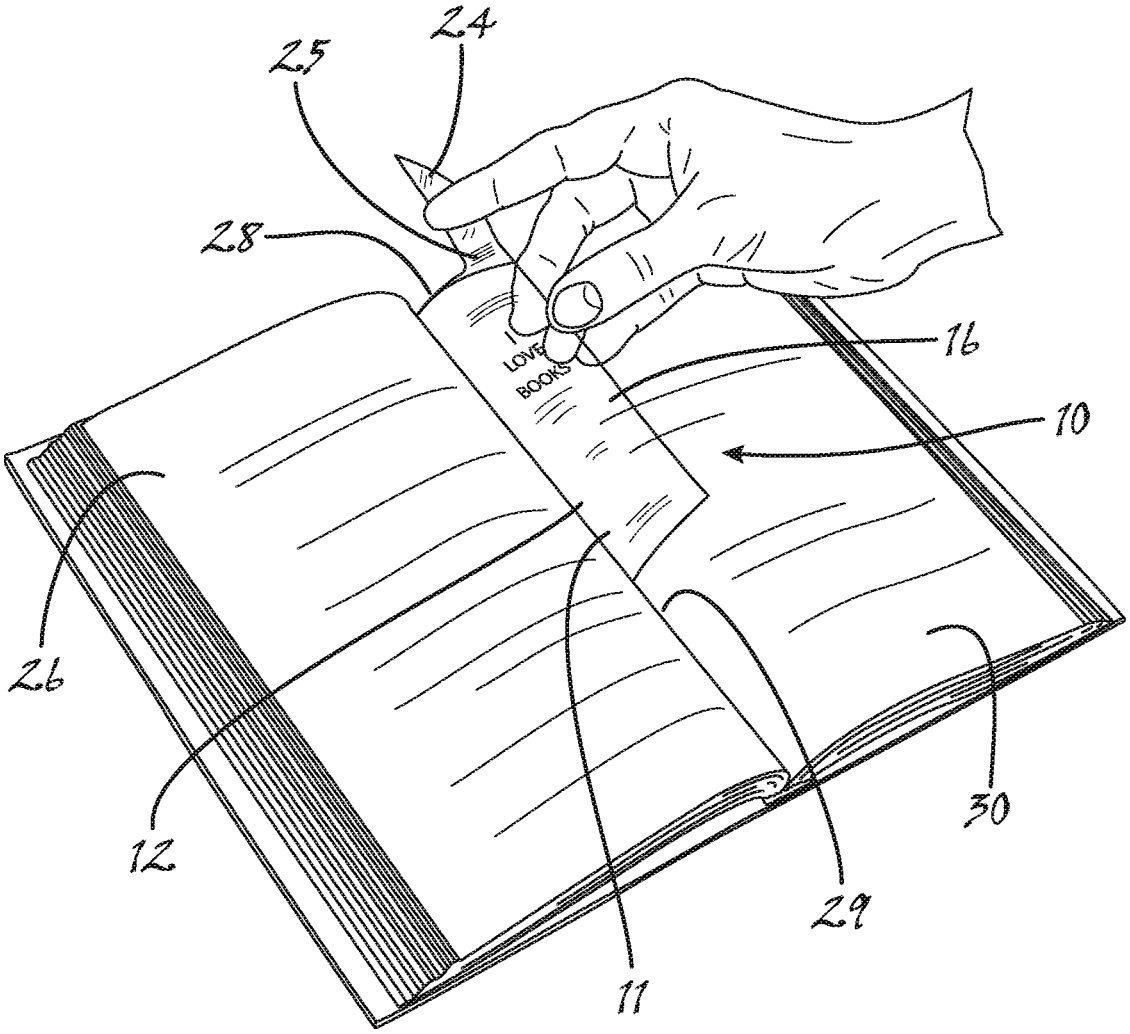
FIG. 3 shows, in a perspective view, details of the initial placement for use with a book of an anchor part of the dual page bookmark of FIG. 1.

Referring now to FIG. 3, initial placement of the dual page bookmark 10 of the present invention is shown to begin with the selection of a page of the book 26 beyond the current page 27, which page will be the "goal" page 30. Once selected, the anchor 11 portion of the bookmark 10 is nestled into place adjacent the spline edge 29 of the goal page 30, with the top edge 13 of the anchor 11 positioned generally along the top edge 28 of the goal page 30 of the book 26. With the anchor 11 so positioned, as shown in FIG. 3, the flap 18 is held up by the reader, as also shown in FIG. 3, and the reader turns back to the current page 27, as shown in FIG. 4, and releases the flap 18 to mark the current page 27. As particularly shown in FIG. 5, both the goal page 30 and the current page 27 of the book 26 are then marked.

Figure 6:
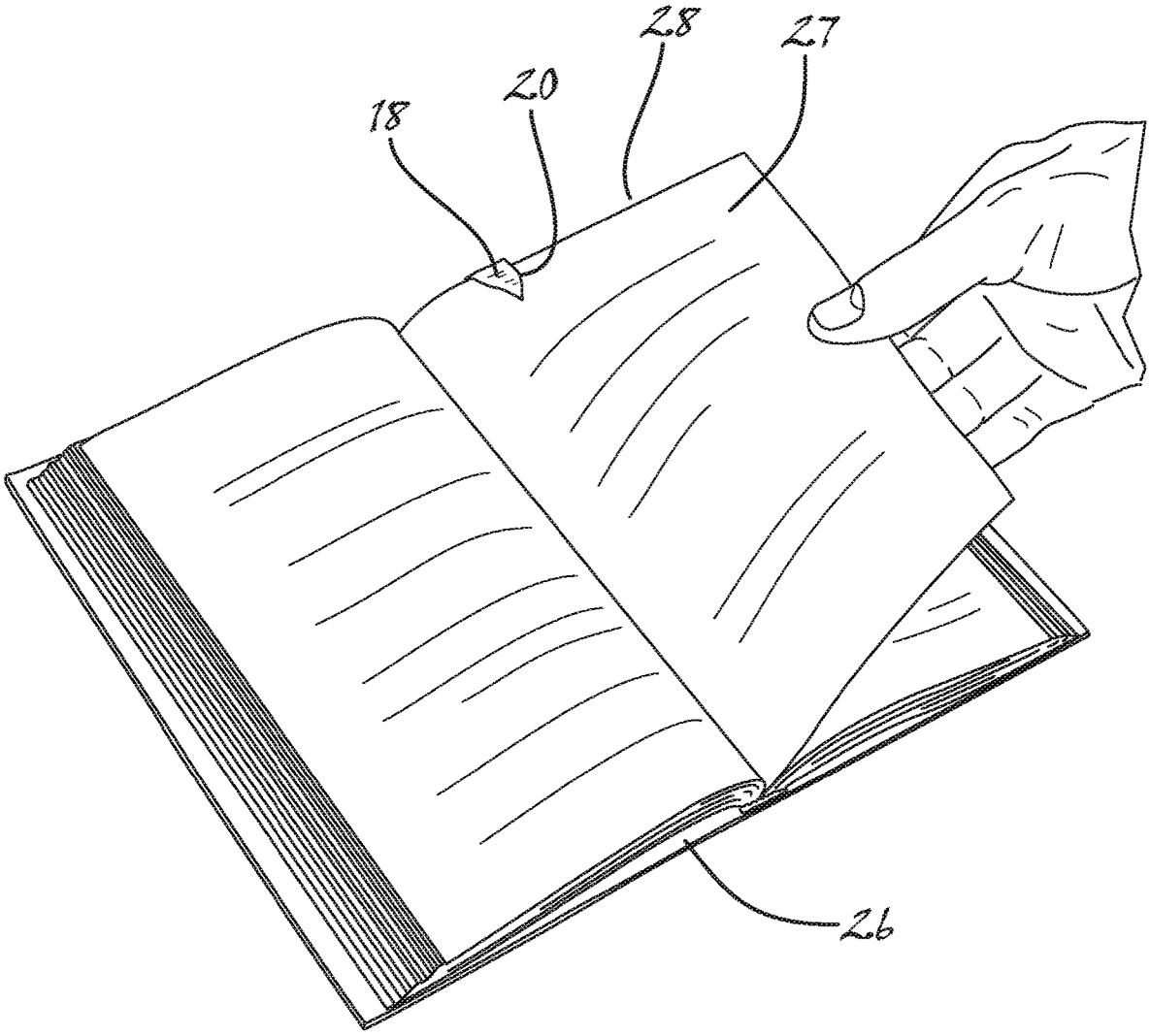
FIG. 6 shows, in a perspective view, details of the operation of the dual page bookmark of FIG. 1, as a reader turns from one page to the next.
Figure 7:
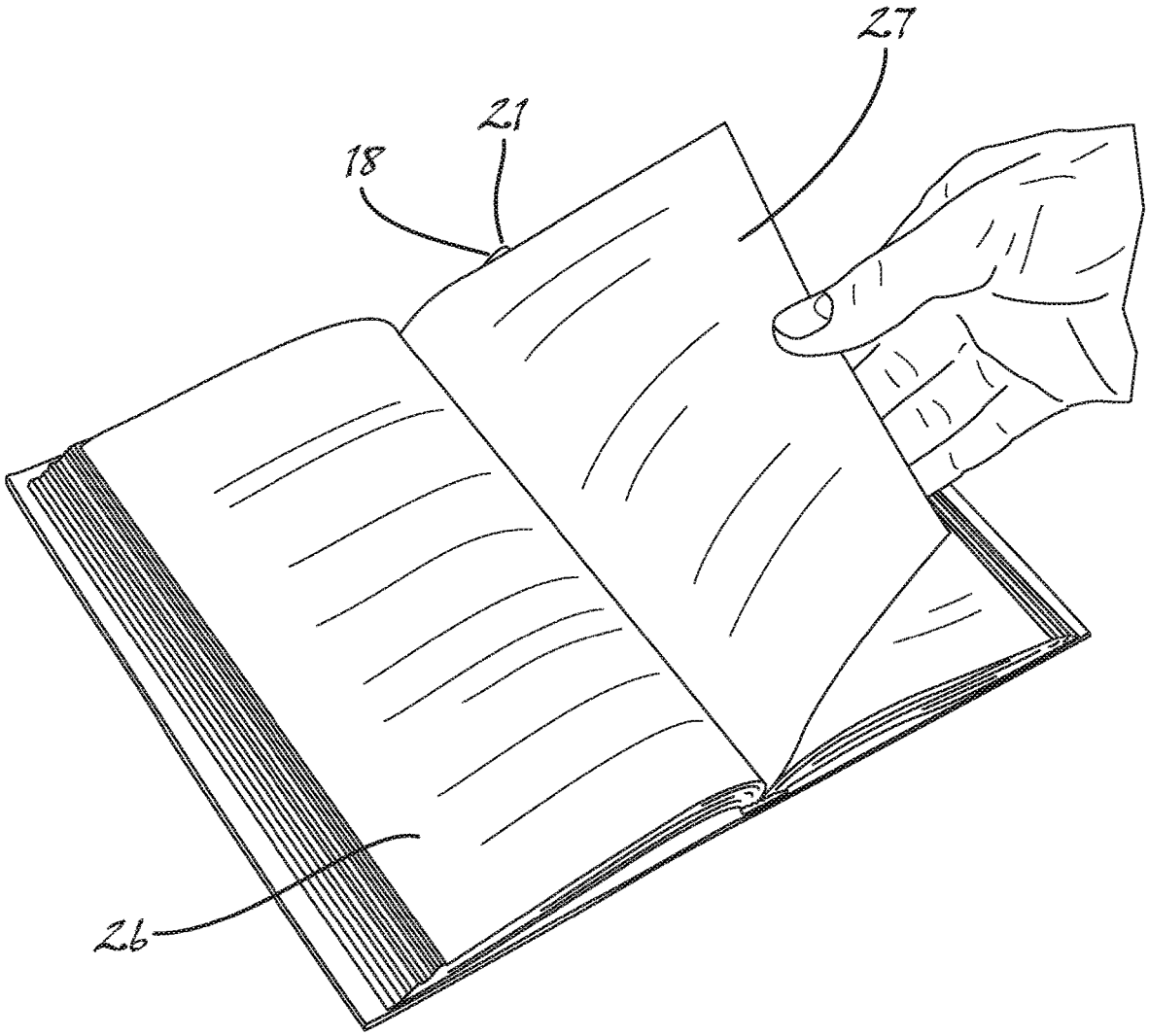
FIG. 7 shows, in a perspective view, further details of the operation of the dual page bookmark of FIG. 1, as a reader turns from one page to the next.

When the reader wishes to turn from the current page 27 to the next following page of the book 26, the reader simple turns the current page 27 as shown in FIGS. 6 and 7. As particularly shown in FIG. 6, the top edge 28 of the current page 27 being turned will engage with the critically provided curved outer edge 20 of the flap 18, thereby causing the flap 18 to raise up to clear the turning current page 27, as shown in FIG. 7. Once cleared, the flap 18 will then automatically drop into place on the next following page, which will then become the current page 27, as shown in FIG. 4. In this manner, the learning reader not only obtains the benefit of having an always visible reading goal, but also is able to automatically keep track of the current page 27.

In order ensure that the flap 18 will automatically drop into place on the next current page 27 as the reader turns from the previous current page 27, the curved interface 25 between the planar portion 24 of the flap 18 and the top edge 13 of the anchor 11 is configured, arranged or otherwise adapted to bias the substantially translucent planar portion 24 of the flap 18 toward the top face 16 of the substantially planar anchor 11. As will be understood by those of ordinary skill in the art, in light of this exemplary description, the required bias may achieved during manufacturing by, for example, forming the material of construction in the desired curved shape or, in the alternative, may be achieved by mechanically shaping the curved interface 25 after initial formation of the bookmark 10.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A dual page bookmark for encouraging personal reading goals, said dual page bookmark comprising:

a planar anchor having a linear interior edge, a top edge, said top edge having a midsection, and a top face;

a flap extending outward from a portion of said top edge of said anchor generally distal said interior edge of said anchor; and wherein said flap comprises:

a curved outer edge extending from said top edge of said anchor to an end point distal said top edge of said anchor;

an interior edge extending from said midsection of said top edge of said anchor to converge with said end point of said outer edge of said flap;

a translucent planar portion; and a curved interface between said planar portion of said flap and said top edge of said anchor, said curved interface being adapted to bias said translucent planar portion of said flap toward said top face of said planar anchor.

2. The dual page bookmark for encouraging personal reading goals as recited in claim 1, wherein said flap is constructed unitary with said anchor.

3. The dual page bookmark for encouraging personal reading goals as recited in claim 1, wherein said anchor and said flap are constructed of plastic film.

4. The dual page bookmark for encouraging personal reading goals as recited in 3, wherein said anchor is provided with printed matter.

5. The dual page bookmark for encouraging personal reading goals as recited in 1, wherein said anchor is provided with printed matter.

6. The dual page bookmark for encouraging personal reading goals as recited in 1, said dual page bookmark further comprising a curved relief between said interior edge of said flap and said top edge of said anchor.

7. A method for automatically marking pages of a book, said for automatically marking pages of a book comprising the steps of:

providing a bookmark comprising:

a planar anchor having a linear interior edge, a top edge, said top edge having a midsection, and a top face;

a flap extending outward from a portion of said top edge of said anchor generally distal said interior edge of said anchor; and wherein said flap comprises:

a curved outer edge extending from said top edge of said anchor to an end point distal said top edge of said anchor;

an interior edge extending from said midsection of said top edge of said anchor to converge with said end point of said outer edge of said flap;

a translucent planar portion; and a curved interface between said planar portion of said flap and said top edge of said anchor, said curved interface being adapted to bias said translucent planar portion of said flap toward said top face of said planar anchor;

inserting said bookmark between pages of a book, wherein said interior edge of said planar anchor is placed adjacent a spline of said book and at a goal page of said book beyond a current page of said book, and said flap is placed at said current page; and turning said current page of said book, thereby causing said flap to raise in a direction away from said top face of said planar anchor and to clear said current page to fall on a next page adjacent said current page.

* * * * *